United States Patent [19]

Onishi

[11] 4,242,993

[45] Jan. 6, 1981

[54] 2-CYCLE ENGINE OF AN ACTIVE THERMOATMOSPHERE COMBUSTION

[75] Inventor: Sigeru Onishi, Kanazawa, Japan

[73] Assignee: Toyota Jidosha Kogyo Kabushiki Kaisha, Toyota, Japan

[21] Appl. No.: 7,177

[22] Filed: Jan. 29, 1979

[30] Foreign Application Priority Data

Feb. 9, 1978 [JP] Japan ..... 53/01294

[51] Int. Cl.[3] ..... F02B 33/04; F02B 75/20

[52] U.S. Cl. ..... 123/59 B; 123/73 R; 123/73 AC; 123/73 A; 123/73 PP

[58] Field of Search ..... 123/73 A, 73 R, 73 AC, 123/73 PP, 59 B

[56] References Cited

U.S. PATENT DOCUMENTS

| | | | |
|---|---|---|---|
| 989,972 | 4/1911 | Herpolsheimer | 123/73 A |
| 3,195,526 | 7/1965 | Jordan | 123/73 A |
| 3,815,558 | 6/1974 | Tenney | 123/73 R |
| 4,066,050 | 1/1978 | Ford-Dunn | 123/73 SP |

FOREIGN PATENT DOCUMENTS

| | | | |
|---|---|---|---|
| 523270 | 7/1940 | United Kingdom | 123/73 AC |

*Primary Examiner*—Wendell E. Burns
*Attorney, Agent, or Firm*—Stevens, Davis, Miller & Mosher

[57] ABSTRACT

A 2-cycle engine having a transfer passage communicating the crank room with the combustion chamber. An accumulation tank having a volume which is larger than the stroke volume of the piston is arranged in the transfer passage. A reed valve is arranged in the transfer passage between the crank room and the accumulation tank.

10 Claims, 3 Drawing Figures

2-CYCLE ENGINE OF AN ACTIVE THERMOATMOSPHERE COMBUSTION

DESCRIPTION OF THE INVENTION

The present invention relates to a 2-cycle engine of an active thermoatmosphere combustion type.

With regard to a 2-cycle engine, it has been known that self ignition of a fresh combustible mixture can be caused in the combustion chamber of an engine without the fresh combustible mixture being ignited by a spark plug. The combustion caused by the above-mentioned self ignition is conventionally called an extraordinary combustion or a run on. When the engine is operating at a high speed under a light load, wherein the above-mentioned extraordinary combustion is caused, the amount of residual exhaust gas remaining in the cylinder of the engine is much larger than that of the fresh combustible mixture fed into the cylinder. Therefore, the fresh combustible mixture fed into the cylinder is heated until it is reformed by the residual exhaust gas, which has a high temperature, and as result, the fresh combustible mixture produces radicals. An atmosphere wherein radicals are produced as mentioned above is hereinafter called an active thermoatmosphere. However, when an extraordinary combustion is caused, the active thermoatmosphere is extinguished at the beginning of the compression stroke, and a hot spot ignition, a mis-fire and a detonation caused by a spark plug are alternately repeated, thus, causing a great fluctuation of torque. Since the extraordinary combustion has drawbacks in that a great fluctuation torque occurs as mentioned above, such an extraordinary combustion is conventionally considered an undersirable combustion.

The inventor conducted research on extraordinary combustion and, as a result, has proven that, if the active thermoatmosphere which is caused in the extraordinary combustion at the beginning of the compression stroke can continue to be maintained until the end of the compression stroke, self ignition of the active thermoatmosphere is caused in the combustion chamber of an engine without the thermoatmosphere being ignited by a spark plug and, then, the active thermoatmosphere combustion takes place. In addition, the inventor has further proven that this active thermoatmosphere combustion results in quiet engine operation and can be caused even if a lean air-fuel mixture is used. This results in a considerable improvement in fuel consumption and a considerable reduction in the amount of harmful components in the exhaust gas. An example of a 2-cycle engine capable of causing such an active thermoatmosphere is disclosed in the Japanese Patent Application No. 52-94133, filed by the same inventor.

An object of the present invention is to provide improvements to the 2-cycle engine disclosed in the above-mentioned Japanese Patent Application, and particularly to provide a 2-cycle engine which is suited to be operated under a partial load for a long time.

According to the present invention, there is provided a 2-cycle engine comprising: an engine body having a cylinder bore and a crank room therein; a piston reciprocally movable in said cylinder bore, said piston and said cylinder bore defining a combustion chamber; an intake passage having mixture forming means therein for introducing a fresh combustible mixture into said crank room; transfer passage means communicating said crank room with an inlet port opening into said combustion chamber; an exhaust passage having an exhaust port opening into said combustion chamber for discharging exhaust gas into the atmosphere; accumulation means arranged in said transfer passage and having a volume which is larger than the stroke volume of said piston, and; check means arranged in said transfer passage between said crank room and said accumulation means for only allowing inflow of the fresh combustible mixture from said crank room to said accumulation means.

The present invention may be more fully understood from the description of preferred embodiments of the invention set forth below, together with the accompanying drawings.

DESCRIPTION OF PREFERRED EMBODIMENTS

Figure 1:
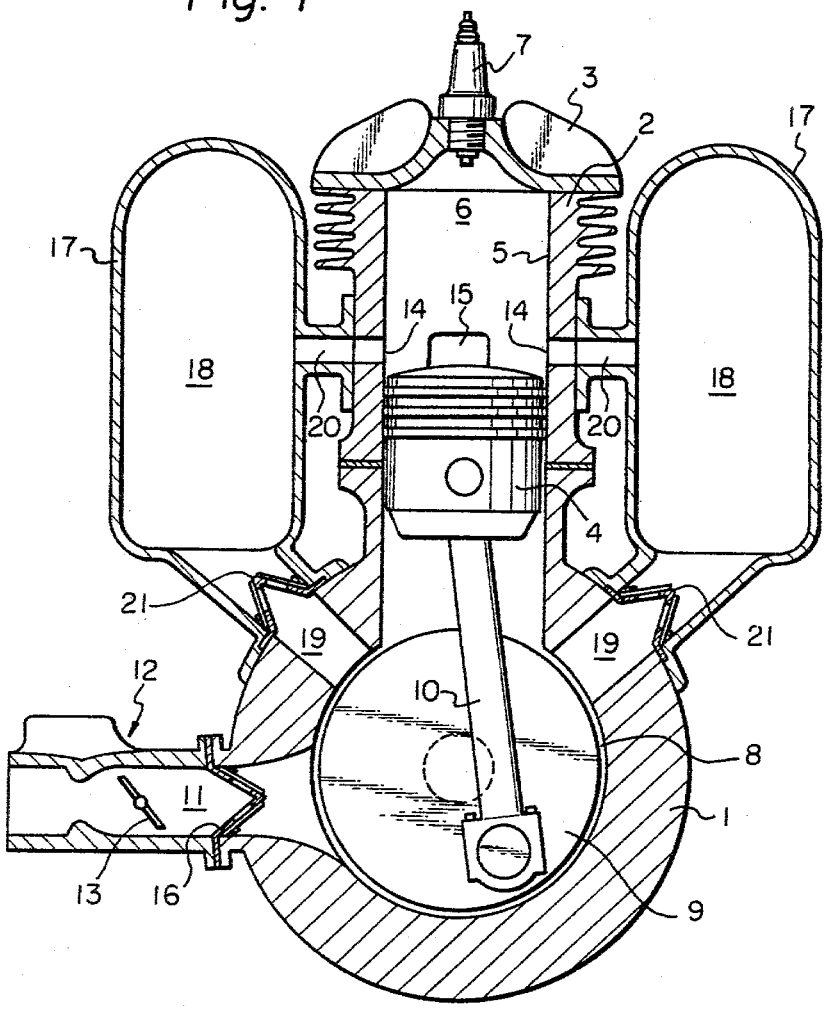
FIG. 1 is a cross-sectional side view of an embodiment of a 2-cycle engine according to the present invention.

Referring to FIG. 1, 1 designates a crank case, 2 a cylinder block fixed onto the crank case, 3 a cylinder head fixed onto the cylinder block 2, 4 a piston having an approximately flat top face and reciprocally moving in a cylinder bore 5 formed in the cylinder block 2 and 6 a combustion chamber formed between the cylinder head 3 and the piston 4; 7 designates a spark plug, 8 a crank room formed in the crank case 1 and 9 a balance weight, 10 a connecting rod, 11 an intake passage, 12 a carburetor and 13 a throttle valve of the carburetor 12; 14 designates a pair of inlet ports, 15 an exhaust port and 16 a reed valve only allowing the inflow of fresh combustible mixture into the crank room 8 from the intake passage 11. As is illustrated in FIG. 1, a pair of accumulation tanks 17, each having a volume which is larger than the stroke volume of the piston 4, are arranged on each side of the cylinder block 2, and an accumulation chamber 18 is formed in each of the accumulation tanks 17. In the embodiment shown in FIG. 1, the accumulation chambers 18 are separated from each other. However, these two accumulation chambers 18 may be interconnected to each other via, for example, a conduit. Each of the accumulation chambers 18 is connected to the crank room 8 via a first transfer passage 19, on one hand, and to the inlet port 14 via a second transfer passage 20, on the other hand. A reed valve 21 only allowing the inflow of fresh combustible mixture into the accumulation chamber 18 from the crank room 8 is arranged in each of the first transfer passages 19. The embodiment illustrated shown in FIG. 1 depicts a Schnürle type 2-cycle engine having an effective compression ratio of 6.5:1.

In operation, a fresh combustible mixture, introduced into the crank room 8 from the intake passage 11 via the reed valve 16, is compressed as the piston 4 moves downward. When the pressure in the crank room 8 is increased beyond that in the accumulation chambers 18, the fresh combustible mixture thus compressed flows into the accumulation chambers 18 via the corresponding reed valves 21. After this, when the piston 4 further moves downwards and opens the inlet ports 14, the fresh combustible mixture in the accumulation chambers 18 flows into the combustion chamber 6 via the corresponding second transfer passages 20. As was mentioned previously, each of the accumulation chambers 18 has a relatively large volume, which is larger than the stroke volume of the piston 4, and therefore, even if a part of the fresh combustible mixture flows out from the accumulation chamber 18 into the combustion chamber 6, the reduction in pressure within the accumulation chamber 18 is extremely small. That is, the pressure difference between the pressure in the combustion chamber 6 and the pressure in the accumulation 18 is maintained approximately constant during the time the inlet ports 14 remain open. Consequently, the fresh combustible mixture flows into the combustion chamber 6 from the inlet ports 14 at an approximately constant speed throughout the inflow operation of the fresh combustible mixture. A conventional 2-cycle engine is so constructed that the fresh combustible mixture flows into the combustion chamber at a high speed immediately after the inlet ports open and, thus, a large part of the fresh combustible mixture is fed into the combustion chamber during the initial stage of the opening of the inlet port. However, considering the case wherein the delivery ratio is set at a certain fixed value, that is, the amount of the fresh combustible mixture fed into the combustion chamber 6 is set at a certain fixed amount, since the fresh combustible mixture flows into the combustion chamber 6 at an approximately constant speed throughout the inflow operation of the fresh combustible mixture in the engine illustrated in FIG. 1, the fresh combustible mixture flows into the combustion chamber 6 at a low speed as compared with the inflow speed of the fresh combustible mixture in a conventional 2-cycle engine. In the engine illustrated in FIG. 1, since the fresh combustible mixture flows into the combustion chamber 6 at a low speed, the movement of the residual burned gas in the combustion chamber 6 is extremely small. As a result, the dissipation of the heat of the residual burned gas is prevented and, thus, the residual burned gas is maintained at a high temperature. In addition, at the beginning of the compression stroke under a partial load of the engine, a large amount of the residual burned gas is present in the combustion chamber 6. Since the amount of the residual burned gas in the combustion chamber 6 is large and, in addition, the residual burned gas has a high temperature, the fresh combustible mixture is heated until radicals are produced and, as a result, an active thermoatmosphere is created in the combustion chamber 6. Further, since the movement of the gas in the combustion chamber 6 is extremely small during the compression stroke, the occurrence of turbulence and the loss of heat energy escaping into the inner wall of the combustion chamber 6 are restricted to the smallest possible extent. Consequently, the temperature of the gas in the combustion chamber 6 is further increased as the compressing operation progresses and, as a result, the amount of radicals produced in the combustion chamber 6 is further increased. When the radcals are produced, the combustion which is called a preflame reaction has been started. After this, when the temperature of the gas in the combustion chamber 6 becomes high at the end of the compression stroke, a hot flame generates to cause self ignition which is not caused by the spark plug 7. Then, the gentle combustion is advanced while being controlled by the residual burned gas. When the piston 4 moves downwards and opens the exhaust port 15, the burned gas in the combustion chamber 6 is discharged into the atmosphere.

Figure 2:
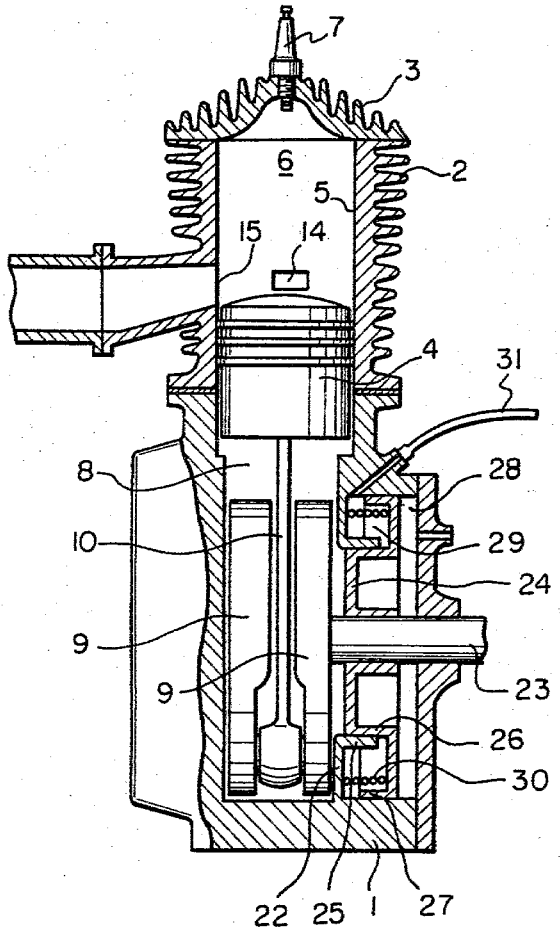
FIG. 2 is a cross-sectional side view of another embodiment according to the present invention.

As the load of an engine is increased and, thus, the amount of air introduced into the crank room 8 via the carburetor 12 is increased, the compression pressure in the crank room 8 is, accordingly increased. As a result of this, the amount of the fresh combustible mixture fed into the combustion chamber 6 is also increased. FIG. 2 illustrates another embodiment of a 2-cycle engine capable of reducing and increasing the amount of the fresh combustible mixture fed into the combustion chamber when an engine is operating under a light and heavy load, respectively, as compared with that in an engine illustrated in FIG. 1. In FIG. 2, it should be noted that the depiction of the accumulation chambers is omitted. Referring to FIG. 2, an annular flange 22, having an L-shape cross section, is formed in one piece on the inner wall of the crank case 1. In addition, a movable piston 24 is slidably mounted on an output shaft 23 fixed onto the balance weight 9, and this movable piston 24 comprises an inner cylindrical portion 26 sealingly sliding on the cylindrical portion 25 of the annular flange 22, and an outer cylindrical portion 27 sealing sliding on the inner wall of the crank case 1. The crank room 8 is isolated from an atmospheric pressure chamber 28 by means of the movable piston 24, and a vacuum chamber 29 is formed between the annular flange 22 and the movable piston 24. A compression spring 30 is arranged in the vacuum chamber 29, so that the movable piston 24 is always urged towards the right in FIG. 2 due to the spring force of the compression spring 30. The vacuum chamber 29 is connected to a vacuum port (not shown) opening into the venturi of the carburetor 12 (FIG. 1) via a vacuum conduit 31. The level of vacuum produced in the venturi of the carburetor 12 is increased as the amount of the introduced air is increased. Consequently, the level of the vacuum produced in the vacuum chamber 29 is also increased as the amount of the introduced air is increased. On the other hand, the compression pressure in the crank room 8 is increased as the amount of the introduced air is increased. However, since the surface area of the movable piston 24, which the vacuum in the vacuum chamber 29 acts on, is larger than the surface area of the movable piston 24, which the pressure in the crank room 8 acts on, the movable piston 24 moves towards the left in FIG. 2 as the amount of the introduced air is increased. Consequently, the volume of the crank room 8 is reduced as the amount of the introduced air is increased.

From FIG. 2, it will be understood that, when the amount of the introduced air is small, that is, when the level of vacuum produced in the vacuum chamber 29 is small, the volume of the crank room 8 is larger than that in the embodiment illustrated in FIG. 1. Consequently, in this embodiment, when the amount of the introduced air is small, the compression pressure in the crank room 8 is reduced. Therefore, at this time, since the inflow velocity of the fresh combustible mixture flowing into the combustion chamber 6 is reduced as compared with that in the embodiment illustrated in FIG. 1, a stable active thermoatmosphere combustion can be ensured. On the other hand, when the amount of the introduced air is large, since the volume of the crank room 8 is reduced, the compression pressure in the crank room 8 is increased. As a result of this, it is possible to feed a sufficiently large amount of the fresh combustible mixture into the combustion chamber 6.

Figure 3:
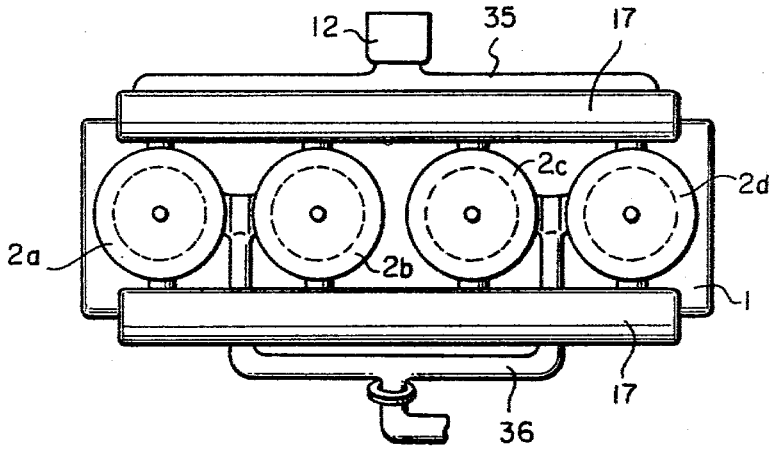
FIG. 3 is a plan view of a further embodiment according to the present invention.

FIG. 3 illustrates the case wherein the present invention is applied to a multi-cylinder 2-cycle engine. Referring to FIG. 3, 1 designates a crank case, 2a, 2b, 2c, 2d cylinder blocks, 35 an intake manifold and 36 an exhaust manifold. As is illustrated in FIG. 3, in this embodiment, the engine is provided with a pair of accumulation tanks 17 common to all of the cylinders of the engine. Each of the accumulation tnaks 17 is connected to the crank rooms via the separate reed valves and the separate first transfer passages (not shown). In the engine illustrated in FIG. 3, if the opening timing of the inlet ports of the cylinders 2a, 2b, 2c, 2d are not overlapped with each other, it is sufficient that the volume of each of the accumulation chambers 17 illustrated in FIG. 3 is equal to that of the accumulation chamber 17 illustrated in FIG. 1. Consequently, in the embodiment shown in FIG. 3, the volume of the accumulation chamber 17 for each cylinder becomes 25 percent relative to the volume of the accumulation chamber 17 of a single-cylinder engine as illustrated in FIG. 1. Therefore, there is an advantage in which, as the number of the cylinders of an engine is increased, the size of the accumulation tank becomes smaller relative to the size of the engine.

According to the present invention, since the active thermoatmosphere combustion is carried out, quiet operation of an engine is obtained, and fuel consumption is considerably improved. In addition, the amount of harmful components in the exhaust gas is considerably reduced. In all of the embodiments, it is not necessary to use the spark plug 7 when the active thermostmosphere combustion is carried out.

While the invention has been described by reference to specific embodiments chosen for purposes of illustration, it should be apparent that numerous modifications could be made thereto by those skilled in the art without departing from the spirit and scope of the invention.

What is claimed is:

1. A 2-cycle engine comprising:

an engine body having a cylinder bore and a crank room therein;

a piston reciprocally movable in said cylnder bore, said piston and said cylinder bore defining a combustion chamber;

an intake passage having mixture forming means therein for introducing a fresh combustible mixture into said crank room;

transfer passage means communicating said crank room with an inlet port opening into said combustion chamber;

an exhaust passage having an exhaust port opening into said combustion chamber for discharging exhaust gas into the atmosphere;

accumulation means arranged in said transfer passage and having a volume which is larger than the stroke volume of said piston, and;

check means arranged in said transfer passage between said crank room and said accumulation means for only allowing inflow of the fresh combustible mixture from said crank room to said accumulation means.

2. A 2-cycle engine as claimed in claim 1, wherein said transfer passage means comprises a transfer passage, said accumulation means comprising a tank arranged in said transfer passage.

3. A 2-cycle engine as claimed in claim 1, wherein said check means comprises a reed valve.

4. A 2-cycle engine as claimed in claim 1, wherein said transfer passage means comprises a pair of transfer passages, said accumulation means comprising a pair of tanks, said check means comprising a pair of check valves, each of said tanks being arranged in said respective transfer passages, each of said check valves being arranged in said respective transfer passages.

5. A 2-cycle engine as claimed in claim 1, wherein said engine further comprises means for varying the volume of said crank room in accordance with changes in the amount of air introduced into said crank room.

6. A 2-cycle engine as claimed in claim 5, wherein said varying means comprises a reciprocal member movably arranged in said crank room, said reciprocal member separating said crank room and the atmosphere and defining a vacuum chamber, said reciprocal member being actuated in response to pressure difference between the pressure in said crank room and the vacuum in said vacuum chamber.

7. A 2-cycle engine as claimed in claim 6, wherein said mixture forming means comprises a carburetor having a venturi, said vacuum chamber being connected to said venturi for decreasing the volume of said crank room in accordance with increases in the level of the vacuum produced in said vacuum chamber.

8. A 2-cycle engine comprising:

an intake passage having mixture forming means therein;

accumulation means, and;

a plurality of cylinders each comprising a reciprocal piston, a crank room connectable to said intake passage for introducing a fresh combustible mixture into said crank room, a combustion chamber defined by said piston, an exhaust passage having an exhaust port which opens into said combustion chamber, at least one first transfer passage communicating said crank room with said accumulation means, at least one second transfer passage connected to said accumulation means and having an inlet port which opens into said combustion chamber, and check means arranged in said first transfer passage for only allowing inflow of the fresh combustible mixture into said accumulation means from said crank room said accumulation means having a volume larger than the stroke volume of said piston.

9. A 2-cycle engine as claimed in claim 8, wherein said accumulation means comprises at least one tank having a volume which is larger than the stroke volume of said piston.

10. A 2-cycle engine as claimed in claim 8, wherein said check means comprises a reed valve.

* * * * *

UNITED STATES PATENT AND TRADEMARK OFFICE

CERTIFICATE OF CORRECTION

PATENT NO. : 4,242,993

DATED : January 6, 1981

INVENTOR(S) : Sigeru ONISHI

It is certified that error appears in the above-identified patent and that said Letters Patent are hereby corrected as shown below:

Item [30] Foreign Application Priority Data, should read:

-- Feb. 9, 1978 [JP] Japan..... 53/12941 --

Signed and Sealed this

*Fourteenth* Day of *July 1981*

[SEAL]

*Attest:*

GERALD J. MOSSINGHOFF

*Attesting Officer*

*Commissioner of Patents and Trademarks*